US005149570A

United States Patent [19]

Cain

[11] Patent Number: 5,149,570

[45] Date of Patent: Sep. 22, 1992

[54] PEEL-OFF PUZZLE

[76] Inventor: Merrie Cain, 14654 Dolphin, Detroit, Mich. 48223-1833

[21] Appl. No.: 585,933

[22] Filed: Sep. 21, 1990

[51] Int. Cl.[5] ..... A63F 9/10; B32B 3/14

[52] U.S. Cl. ..... 428/33; 273/153 R; 428/904.4

[58] Field of Search ..... 428/33, 904.4; 273/153 R, 156, 157 R

[56] References Cited

U.S. PATENT DOCUMENTS

| | | | |
|---|---|---|---|
| 2,011,058 | 8/1935 | Krase | 273/157 R |
| 3,606,338 | 9/1971 | Cannata | 428/33 X |
| 4,053,159 | 10/1977 | Kulak | 428/33 X |
| 4,778,153 | 10/1988 | Bachman et al. | 428/43 X |
| 4,816,302 | 3/1989 | Shaw | 428/33 |

*Primary Examiner*—Henry F. Epstein
*Attorney, Agent, or Firm*—Harness, Dickey & Pierce

[57] ABSTRACT

A jigsaw puzzle having self-adhesive pieces is provided. Each piece has a first sheet with a pictorial image on one surface, and an adhesive sheet bonded to the opposing surface. The adhesive sheet has a pressure sensitive adhesive surface opposite the first sheet. A release sheet substantially covers the pressure sensitive adhesive surface and is readily removable by means of a pull flap to expose the pressure sensitive adhesive surface. In practice, the individual puzzle pieces can be simultaneously assembled on and bonded to a mounting board. The mounting board can then be framed and hung for viewing.

2 Claims, 1 Drawing Sheet

PEEL-OFF PUZZLE

BACKGROUND OF THE INVENTION

The present invention relates generally to puzzles that, when assembled, are suitable for framing. More specifically, this invention relates to a jigsaw puzzle composed of pieces having a pressure sensitive adhesive backing which facilitates assembly and mounting of the jigsaw puzzle within a picture frame.

DESCRIPTION OF THE PRIOR ART

Jigsaw puzzles have long been known to be an enjoyable pastime. Generally, the intention is to be able to assemble and disassemble a jigsaw puzzle for continued use over many years. However, it has also become popular for many to mount, frame and hang on a wall those jigsaw puzzles displaying a particularly pleasant or favorite image.

Various methods have been proposed to bond a preassembled puzzle to a mounting board for purposes of framing. U.S. Pat. No. 3,606,338 to Cannata discloses a method wherein a puzzle is assembled upon a first surface. Using a combination of boxes and surfaces, the preassembled puzzle is eventually placed face down. A mounting surface having an adhesive applied thereon is then placed against the backside of the assembled puzzle for bonding. The puzzle as bonded to the mounting surface can then be framed and hung.

Cannata provides a convenient adhesion method which includes a release sheet covering a pressure sensitive adhesive on the mounting surface. Once removed, the adhesive surface is ready for bonding to the backside of the preassembled puzzle. However, the method disclosed by Cannata is complicated by the number of surfaces and boxes required to accomplish the mounting of the puzzle. In addition, the procedure is aggravated by the likelihood of the pieces of the preassembled puzzle becoming loose during one of the several transfer steps between surfaces and boxes.

A variation on the use of the pressure sensitive adhesive used by Cannata is illustrated in U.S. Pat. No. 4,778,153 to Bachman et al. There, the pressure sensitive adhesive is used to temporarily retain a removable portion on a game piece. The pressure sensitive adhesive is bonded to the removable portion such that when the removable portion is peeled off the gaming card, the removable portion along with the adhesive is discarded, and only the game card is kept.

U.S. Pat. No. 4,053,159 to Kulak discloses another method for framing a preassembled puzzle. There, a frame circumscribing a mounting board is provided wherein an adhesive is applied to the mounting surface of the mounting board. The preassembled puzzle is then supported above the surface of the mounting board by a slide board. By sliding the preassembled puzzle off the slide board and dropping it onto the adhesive surface of the mounting board, the puzzle then resides within the frame and is ready for hanging. Again, Kulak requires a preassembled puzzle for accomplishing the method disclosed. In contrast to Cannata, Kulak does not use the convenient adhesive surface having a release sheet, but requires an adhesive to be applied to the mounting surface by the user.

From the above discussion, it can be readily appreciated that the prior art does not disclose a jigsaw puzzle that can be bonded to a mounting board while the puzzle is being assembled. Nor does the prior art disclose a method for hanging a puzzle that does not require a number of complicated or awkward steps. Therefore, it would be desirable to provide a jigsaw puzzle in which each piece has an adhesive on its back surface for individually adhering the pieces to a mounting board during the process of assembling the puzzle. It would be additionally desirable that such an adhesive surface be covered by a release sheet that is readily removable for purposes of assembling the puzzle.

Accordingly, this invention provides a jigsaw puzzle whose individual pieces have a pre-applied pressure sensitive adhesive which is covered and protected by a readily removable release sheet.

SUMMARY OF THE INVENTION

According to the present invention, there is provided a jigsaw puzzle having a plurality of pieces which when assembled form the jigsaw puzzle. Each jigsaw piece has a first sheet having a front surface and a back surface. Upon the front surface is disposed a portion of the composite image of the puzzle intended for viewing within the picture frame. Bonded to the back surface is an adhesive which is covered by a release sheet. The release sheet is removable to expose the adhesive.

In the assembly process of the puzzle, each piece may be fitted individually to the puzzle prior to removing the release sheet and exposing the adhesive surface. As a result, each piece can be assured proper fit before the release sheet is removed and the piece is permanently bonded to a mounting surface. Additionally, once all of the pieces are assembled and bonded to the mounting surface, the completed puzzle is immediately ready for framing and hanging.

As a consequence of this uncomplicated method for assembling and framing the jigsaw puzzle, many disadvantages of the prior art are overcome. The pressure sensitive adhesive overcomes the need for any glue to be applied by the user, thereby avoiding the additional mess and cost. In addition, there is no waiting for the glue to bond prior to hanging. Also, as is common with glues, there is no deformation of the mounting board or the puzzle pieces as a result of saturation by the glue.

Another advantage of the present invention is the manufacturability of the jigsaw puzzle. The adhesive and release sheet can be placed respectively on the backside of the puzzle prior to the stamping process which severs the puzzle into individual pieces. No complicated tooling or steps are required to accomplish the desired item.

Accordingly, it is an object of the present invention to provide an uncomplicated method for assembling a jigsaw puzzle for purpose of mounting, hanging and framing.

It is a further object of this invention that such jigsaw puzzle utilizes a pressure sensitive adhesive for bonding the individual jigsaw pieces to the mounting surface.

It is still a further object of this invention that such pressure sensitive adhesive is protected prior to use by a release sheet which is readily removable.

Other objects and advantages of this invention will be more apparent after a reading of the following detailed description taken in conjunction with the drawings provided.

DETAILED DESCRIPTION OF THE PREFERRED EMBODIMENT

Figure 1:
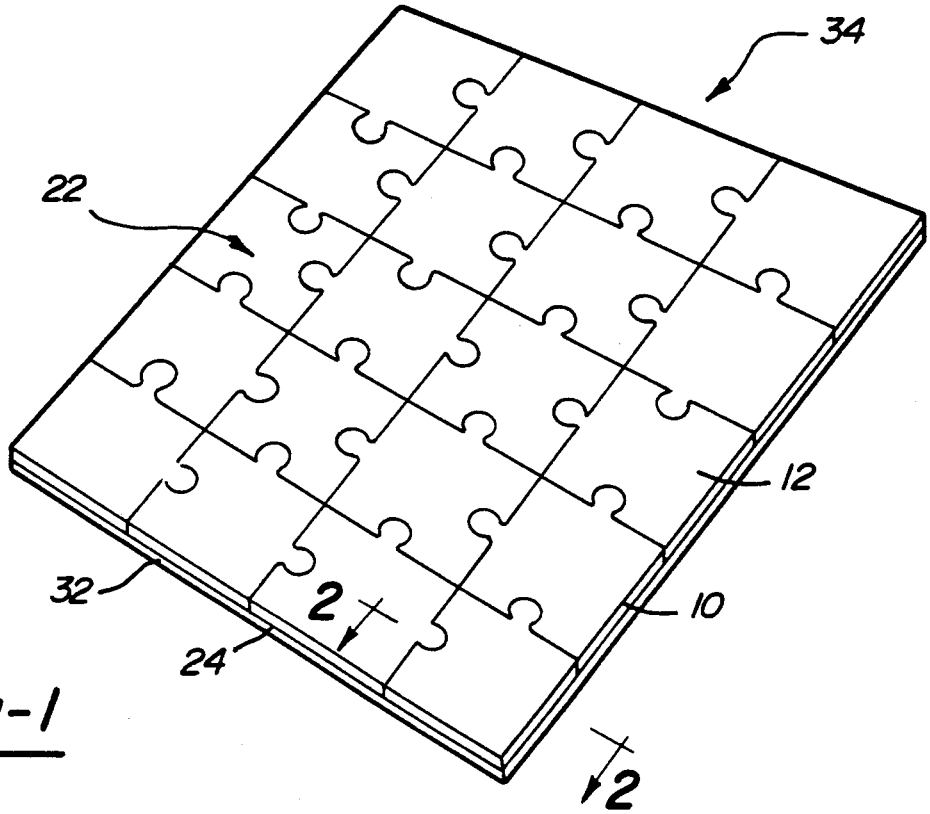
FIG. 1 is an elevation view of an assembled jigsaw puzzle as it is mounted and bonded to a mounting board in accordance with the preferred embodiment of this invention.
Figure 2:
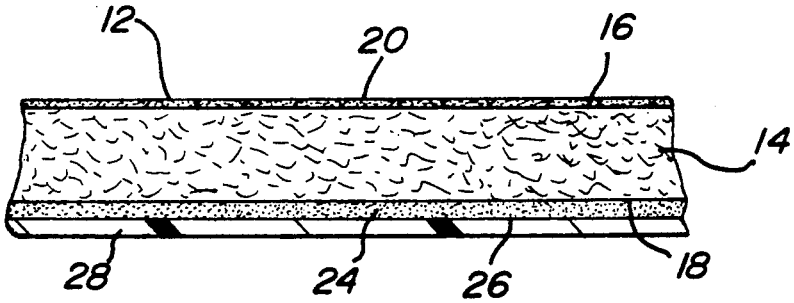
FIG. 2 is a vertical cross sectional view through line 2—2 of the jigsaw puzzle shown in FIG. 1.
Figure 3:
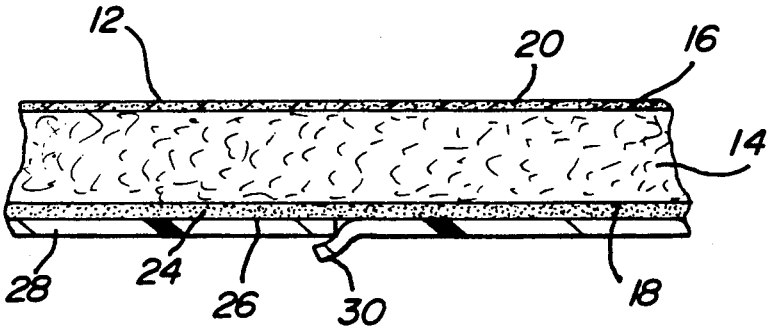
FIG. 3 shows a vertical cross section of a jigsaw puzzle piece in accordance with a second embodiment of this invention.

In a preferred embodiment of this invention, a jigsaw puzzle 10 is provided which is composed of a plurality of interlocking pieces 12 as shown in FIG. 1. As better seen in FIG. 2, each piece 12 has a rigid sheet 14 having a front surface 16 and back surface 18. Disposed on the front surface 16 is a fragmentary image 20. The image 20 on each piece 12 composes in combination with the other interlocking pieces 12 a composite image 22 on the jigsaw puzzle 10 as shown in FIG. 3.

An adhesive sheet 24 is bonded to and substantially covers the back surface 18 of the rigid first sheet 14. The adhesive sheet 24 has a pressure sensitive adhesive surface 26 opposite the back surface 18 of the rigid first sheet 14. Upon the adhesive surface 26 there is disposed a release sheet 28 which covers the surface of the adhesive.

A pull flap 30 may be provided to facilitate removal of the release sheet 28. By reducing the coverage of the back surface 18 by the adhesive sheet 24, the portion of the release sheet 28 that extends beyond the adhesive sheet 24 may act as the pull flap 30. Alternatively, the release sheet 28 may be removable from the surface of the adhesive surface 26 by means of the pull flap 30 shown in FIG. 3. There, the pull flap 30 is formed by applying the release sheet 28 a overlapping strips to the adhesive surface 26 of the adhesive sheet 24 prior to cutting the individual pieces 12.

Upon removal of the release sheet 28, the pressure sensitive adhesive surface 26 is exposed for purposes of adhering the piece 12 to a mounting board 32. Once all pieces 12 are assembled, the completed jigsaw puzzle 10 forms with the mounting board 32 a mounted puzzle 34 ready for framing and hanging.

In practice, the interlocking pieces 12 can be first assembled to form the composite image 22 of the jigsaw puzzle 10 prior to removal of the release sheet 28 from each individual piece 12. This practice would require turning the entire puzzle 10 over on its front surface 16 for removal of the release sheet 28. However, as a significant advantage over the prior art, a more convenient method for assembling the puzzle 10 is to individually remove the release sheet 28 from each piece 12 after assuring a proper fit with its adjacent interlocking pieces. As a result, the puzzle 10 is assembled and bonded to the mounting board 32 simultaneously. A frame (not shown) can then be attached by any suitable means to the mounting board 32 to frame the mounted puzzle 34 for purposes of hanging on a wall.

In addition, a significant advantage of the present invention is that there are no requirements for providing a liquid glue to the backside of each piece 12. The disadvantages of using a glue, such as additional cost and mess, waiting for the glue to set, and the deformation of the puzzle pieces 12 from saturation by the glue, are all avoided.

Thus, a jigsaw puzzle 10 made by the disclosed method can be quickly made ready for hanging without additional and complicated steps or the need for additional supplies.

While the invention has been described in terms of a preferred embodiment, it is apparent that other forms could be adopted by one skilled in the art. Accordingly, the scope of the invention is to be limited only by the following claims.

What is claimed is:

1. A jigsaw puzzle having a plurality of interlocking pieces which can be adhered to a receiving surface during assembly, each of said plurality of interlocking pieces comprising:

a rigid first sheet, said first sheet having a front surface and a back surface, said front surface having an image disposed thereon for viewing, said image in combination with other of said plurality of interlocking pieces comprising a composite image on said jigsaw puzzle;

an adhesive sheet bonded to said back surface, said adhesive sheet substantially covering said back surface and having a pressure sensitive adhesive surface substantially covering said adhesive sheet opposite said back surface;

a release sheet substantially covering said pressure sensitive adhesive surface of said adhesive sheet, said release sheet including means for ready removal for exposing said pressure sensitive adhesive surface; and whereby each of said plurality of interlocking pieces can be simultaneously assembled and adhered to said receiving surface to form a mounted jigsaw puzzle ready for hanging upon a wall.

2. A jigsaw puzzle as claimed in claim 1, wherein said means for ready removal of said release sheet comprises a pull flap to assist in removing said release sheet from said pressure sensitive adhesive surface.

* * * * *